US005330160A

United States Patent [19]

Eisermann et al.

[11] Patent Number: 5,330,160

[45] Date of Patent: Jul. 19, 1994

[54] GAS STIR PLUG WEAR INDICATOR INCLUDING LOW MELTING POINT COMPONENT AND METHOD OF USE

[75] Inventors: Eckehard Eisermann, Vermilion; Robert Mascara, Canfield, both of Ohio

[73] Assignee: Martin & Pagenstecher, Inc., North Olmstead, Ohio

[21] Appl. No.: 59,403

[22] Filed: May 11, 1993

[51] Int. Cl.[5] ..... B22D 41/58

[52] U.S. Cl. ..... 266/44; 266/100; 266/220

[58] Field of Search ..... 266/100, 99, 236, 220, 266/44; 73/86

[56] References Cited

U.S. PATENT DOCUMENTS

| | | | |
|---|---|---|---|
| 4,749,172 | 6/1988 | Detalle et al. | 266/220 |
| 4,971,295 | 11/1990 | Rothfuss et al. | 266/220 |
| 5,007,366 | 4/1991 | Handler | 266/220 |
| 5,202,079 | 4/1993 | Winkelmann et al. | 266/100 |

*Primary Examiner*—Scott Kastler
*Attorney, Agent, or Firm*—Caesar, Rivise, Bernstein, Cohen & Pokotilow, Ltd.

[57] ABSTRACT

A gas stirring plug for introducing gas into a mass of molten metal. The plug is a generally frusto-conical shaped member which is worn away during use and which should be replaced when it has worn away to a predetermined point and comprises a shell, a core, and a low melting point component disposed within a cavity in the core. The core is located within the shell and is comprised of a refractory material extending between the bottom end and the top end of the plug. The cavity is of a predetermined height and has a bottom located a first predetermined distance above the bottom end of the plug. The cavity is filled with the low melting point component, e.g., soapstone, calcium silicate, talcum, or some other material having a melting point lower than steel, from its bottom to an intermediate point located a predetermined height above the bottom of the cavity. Mortar or some other high melting point refractory component is disposed in the cavity from the intermediate point to the top of the plug. The device is operative so that when it has worn away to the intermediate point the low melting point component will be exposed to the molten metal, whereupon it will melt and flow out the cavity and molten metal flows will flow therein to provide a predetermined visual appearance, e.g., a glowing dot surrounded by a darker area. That predetermined visual appearance changes, e.g., the glowing dot disappears, when the plug has worn away to the bottom of the cavity, thereby indicating that it should be replaced.

15 Claims, 2 Drawing Sheets

GAS STIR PLUG WEAR INDICATOR INCLUDING LOW MELTING POINT COMPONENT AND METHOD OF USE

BACKGROUND OF THE INVENTION

This invention relates generally to devices for insufflating gas into a mass of molten metal such as steel, and more specifically, to an optical wear indicator that indicates when the device should be replaced.

The making of steel or other metals typically involves the introduction of gases into the ladle or vessel holding the molten metal to stir it. The gas is typically introduced into the ladle via a device called a stir plug. Such a stir plug may be mounted in the bottom or side of the vessel. Prior art stir plugs have taken numerous forms and constructions.

For example, one common type of stir plug comprises a solid, non-gas-permeable, conical refractory member disposed within a loose fitting metal or ceramic shell or canister. Such a "canistered" plug is commonly disposed within a seating block in the wall, e.g., the bottom, of the vessel holding the molten metal, and the purging gas is transported through the gap between the refractory cone and the metal canister into the molten metal.

Another common type of stir plug comprises a conical shaped member or plug formed of a porous refractory material through which the purging (stirring) gas is passed to produce fine gas bubbles to stir the molten metal. Thus, that type of plug utilizes the porosity of the material forming the plug to create a capillary system formed by the interstitial spaces between the porous material for carrying the stirring gas through the plug. Such plugs are commonly disposed within a seating block in the wall such as the bottom of the vessel.

Another type of uncanistered plug is the so-called directed porosity plug. That plug comprises a conical body of cast refractory material containing an array of fine (0.7 mm diameter) channels that run in a straight line from the bottom to the top of the plug. When these plugs are used, the gas is distributed very finely in the molten metal by means of the capillaries, but as it passes through the capillaries, it undergoes a very high degree of friction loss as a result of the turbulence which develops on the inside surfaces of the capillaries. The effects of this turbulence on the flow of gas decreases with increasing size of the capillary cross section. Thus, it is not possible to increase the diameter of the capillaries to any desired extent in order to minimize friction, since such action would enable the molten metal to penetrate too deeply into the capillaries and block them in the event that the flow of gas should cease.

Only a large number of capillaries can guarantee the very high gas flow rate frequently desired in a steel mill. From the production angle, however, this turns out to be very expensive. Thus, to reduce friction losses, it was found advantageous to form a conical stirring plug of a single or multi-part construction to provide plural identical joints (in the case of a multi-part construction) or slots or passageways (in the case of a single part construction) extending linearly from the bottom to the top of the plug. Such "jointed/slotted" plugs exhibit similar gas agitation properties as the capillary tube plugs, but with significantly smaller pressure losses.

Other types of prior art stir plugs are also disclosed in the following U.S. Pat. Nos.: 4,438,907 (Kimura et al.); 4,535,975 (Buhrmann et al.); 4,539,043 (Miyawaki et al.); 4,560,149 (Hoffgen); 4,647,020 (Leisch); 4,657,226 (Illemann et al.); 4,741,515 (Sharma et al.); 4,836,433 (Perry); 4,840,356 (Labate); 4,858,894 (Labate); 4,884,787 (Dotsch et al.); 4,898,369 (Perry); 4,899,992 (Thrower et al.) 4,905,971 (Rothfuss et al.); and 4,925,166 (Zimmermann).

Any refractory material, such as any of the foregoing stir plug devices, is subject to wear due to extreme operating conditions. As the stir plug is worn down, the longitudinal height of the plug decreases. Stir plugs must be replaced as soon as a certain critical minimal, residual or remnant height is reached. If the stir plug is permitted to erode too much before it is replaced, a burn-out of the ladle in which the stir plug is located might occur, which is not only dangerous, but costly to replace.

Stir plugs with various devices to facilitate the determination of the critical remnant height have been generally available but with certain tradeoffs. For example, electrical indicators are generally available, but they may be expensive to install and maintain, they require an external recording apparatus and are a possible source of disturbance in an already error sensitive system.

One type of electrical indicator is the device described in the U.S. Pat. No. 4,481,809 (LaBate) which utilizes several Hall effect transducers and circuitry to monitor the output thereof.

Another electrical indicator is that disclosed in German Patent No. DE 3,424,466 (Grabner) which utilizes two electrical wires within a probe. Both ends of the wires at the tip of the probe are separated. The wires consist of an alloy that melts at the critical temperature which indicates the critical wear height. The melting alloy closes the circuit and allows an electrical current to flow from the power source. Temperature indicators are also available, but suffer from similar drawbacks as do the electrical indicators. One such device is the one disclosed in German Patent No. DE 3,526,391 (Fischer) which utilizes a thermocouple located inside the body of a ceramic stir plug. The critical temperature inside the plug is measured to determine the critical wear height of the plug. One deficiency of this device however, is that in the event the temperature of the liquid metal destroys the thermocouple, the temperature can no longer be measured and therefore the plug may have to be prematurely replaced.

Other prior art devices measure thermal conductivity to provide an indication of the lifetime of a stir plug. For example, German Patent No. DE 3,833,503 (Rothfuss) discloses a valve configuration inside a ceramic gas stir plug. A low melting alloy keeps the gas flow valve control in the open position. Concurrent with the erosion of the stir plug, high temperatures will ultimately cause the alloy component to melt. This causes the gas flow valve to close, thus either reducing or eliminating gas flow. The reduced or discontinued gas flow indicates the stir plug wear.

Another device disclosed in German Patent No. DE 3,623,609 (Rothfuss) uses a gas flow restriction as a wear indicator. However, a gas flow restriction is not an unmistakable criterion, because a premature steel penetration of the gas passageways result in a low gas flow, thus causing a premature replacement of the stir plug.

German Patent No. DE 3,802,657 (Winkelmann) discloses a refractory wear indicator incorporated in a gas stir plug. This device is an optical indicator which makes use of the geometrical arrangement of the gas passageways situated inside the plug. A certain configuration of gas passageways inside the refractory cone separates the inner refractory portion from the outer one. The inner portion includes a round cross section at the tip of the stir cone. The round cross section changes into a square one at the bottom of the refractory cone. In use, when the metal has been tapped from the ladle and the stir plug is hooked up to a natural gas purging line, the natural gas escapes in a circle configuration from the plug. If the plug is worn down below the critical height, the configuration of the natural gas flames changes from round to square. This indicator system can only work as long as the gas passageways are free from steel. Steel penetration of the passageways prevents gas flow, thus rendering the passageways invisible.

U.S. Pat. No. 4,744,544 (LaBate et al.) describes a visual wear indicator for a metallurgical vessel that uses a metal rod which is inserted in the upper portion of a refractory body and extends inwardly of the surface of the body, at a length less than the known thickness of the refractory body. In this device, the metal rod and the refractory material therearound are elevated to the same temperature by the molten metal, but their light emission coefficients will be different whereupon the end of the rod will glow red hot while the surrounding refractory material exhibits a different color (appearance). Thus, one can readily determine if the cone has worn down beyond the length of the rod. While this wear indicator is generally suitable for its intended purposes, it still leaves much to be desired. In this regard, since the refractory plug and the steel rod of this wear indicator have different thermal expansion coefficients, elevated temperatures will result in different expansions of both materials, which action may crack the refractory body. Moreover, a faster wear of the refractory cone may occur, in part, caused by the drilling of the hole to accommodate the metal indicator. Further, the metal rod may be blown out of its hole by high gas pressure or it may prematurely melt away, thus effecting a premature plug exchange.

In copending U.S. patent application, Ser. No. 07/868,598, filed on Apr. 14, 1992, entitled Gas Stir Plug With Visual Wear Indicator, there is disclosed a gas stir plug device with a visual wear indicator which overcomes many of the disadvantages of the prior art. In particular, that device is of frusto-conical shape for introducing gas into a mass of molten metal and comprises a plug having an outer core formed of a first refractory material. A wear indicator in the form of a central core comprised of a second refractory material is located within a centrally located recess in the outer core adjacent the bottom end of the plug. The central core extends from the bottom end of the plug towards the top end of the plug and is of a predetermined height less than that of the outer core. The upper end of the central core when exposed by the erosion of the stirring plug provides a visual indication of when that plug should be replaced.

While the aforementioned invention overcomes many of the disadvantages of the prior art it still leaves something to be desired from the standpoints of simplicity of construction and cost.

Accordingly, a need exists for a visual wear indicator for a gas stir plug which overcomes the disadvantages of the prior art.

OBJECTS OF THE INVENTION

It is a general object of this invention to provide a gas stir plug with a wear indicator which overcomes the disadvantages of the prior art.

It is a further object of this invention to provide a gas stir plug with a wear indicator which is simple in construction.

It is still a further object of this invention to provide a gas stir plug with a wear indicator which can be manufactured easily and inexpensively.

It is yet a further object of this invention to provide a gas stir plug with a wear indicator which is effective in operation.

It is yet still another object of this invention to provide a gas stir plug device with a visual wear indicator which is simple in construction and reliable.

SUMMARY OF THE INVENTION

These and other objects of this invention are achieved by providing a device and method of use for introducing gas into a mass of molten metal. The device comprises a plug of a generally frusto-conical shape which is worn away during use and which should be replace when it has worn away to a predetermined point, i.e., a residual or remnant height.

The plug comprises a central longitudinal axis, a top end, a bottom end, a core, and a low melting point component. The core is comprised of a refractory material extending between the bottom end and the top end of the plug and has a cavity therein of a predetermined height extending along the longitudinal axis. The bottom of the cavity is located a predetermined distance below the top of the plug adjacent the predetermined point making up the remnant height of the plug, i.e., the remnant height point. The low melting point component, e.g., soapstone, talcum, calcium silicate, or some other material having a melting point lower than steel, is located within the bottom portion of the cavity and extends up to an intermediate point below the top of the plug. In accordance with a preferred embodiment of this invention a high melting point refractory material, e.g., a high grade mortar or a high grade plastic ram mix, is disposed within the cavity above the low melting point component.

The device is operative so that when it has worn away to the top of the low melting point component, that component melts and flows out of the cavity and molten metal flows therein to provide a predetermined visual appearance, e.g., a glowing dot surrounded by a darker colored area. That predetermined visual appearance changes, i.e., the glowing dot disappears, when the plug has worn away to the predetermined remnant height point, thereby indicating that it should be replaced.

DESCRIPTION OF THE DRAWINGS

Other objects and many attendant features of this invention will become readily appreciated as the same becomes better understood by reference to the following detailed description when considered in connection with the accompanying drawing wherein.

DETAILED DESCRIPTION OF THE PREFERRED EMBODIMENTS

Figure 1:
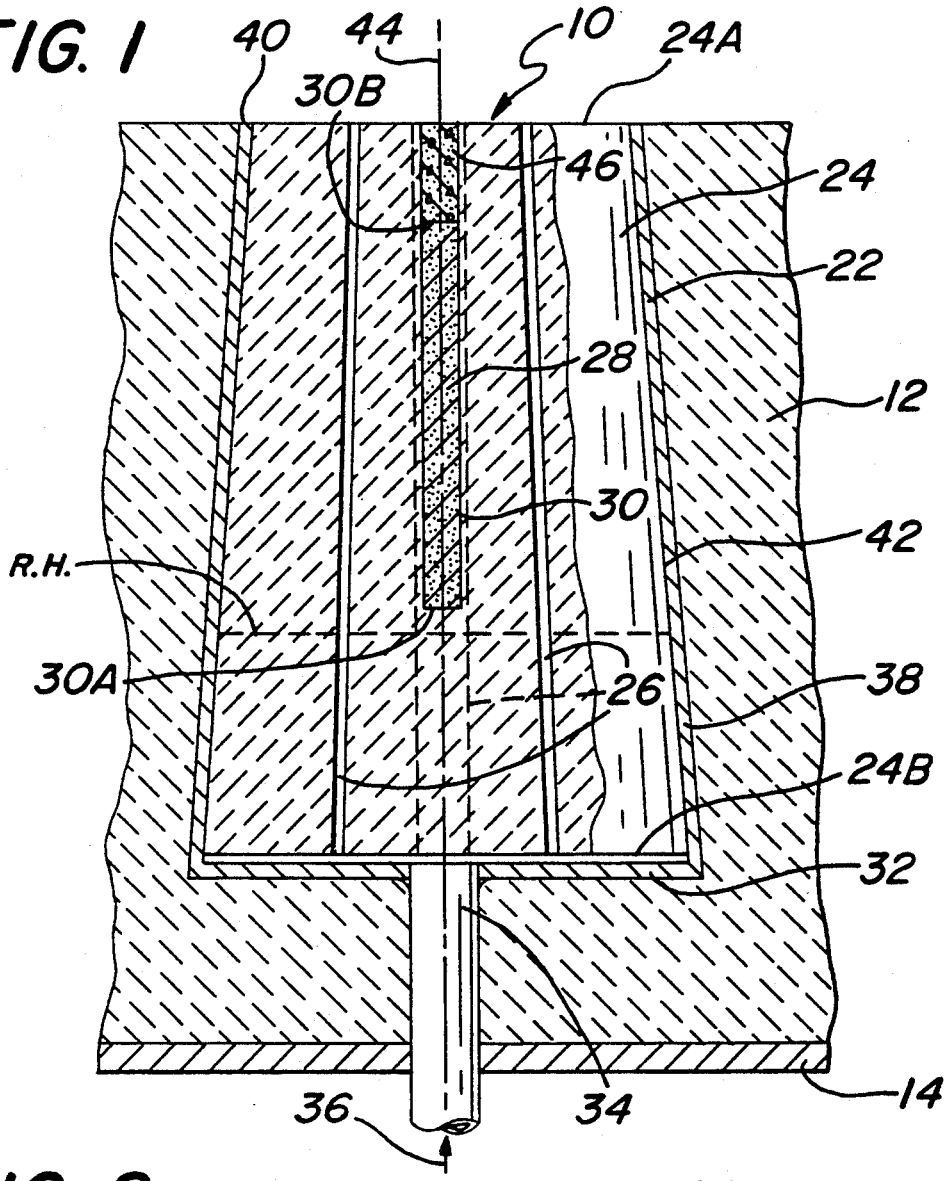
FIG. 1 is a front elevational view, partially in section, showing the stirring plug of this invention in one manner of use in a refractory block lined steel making vessel.
Figure 4:
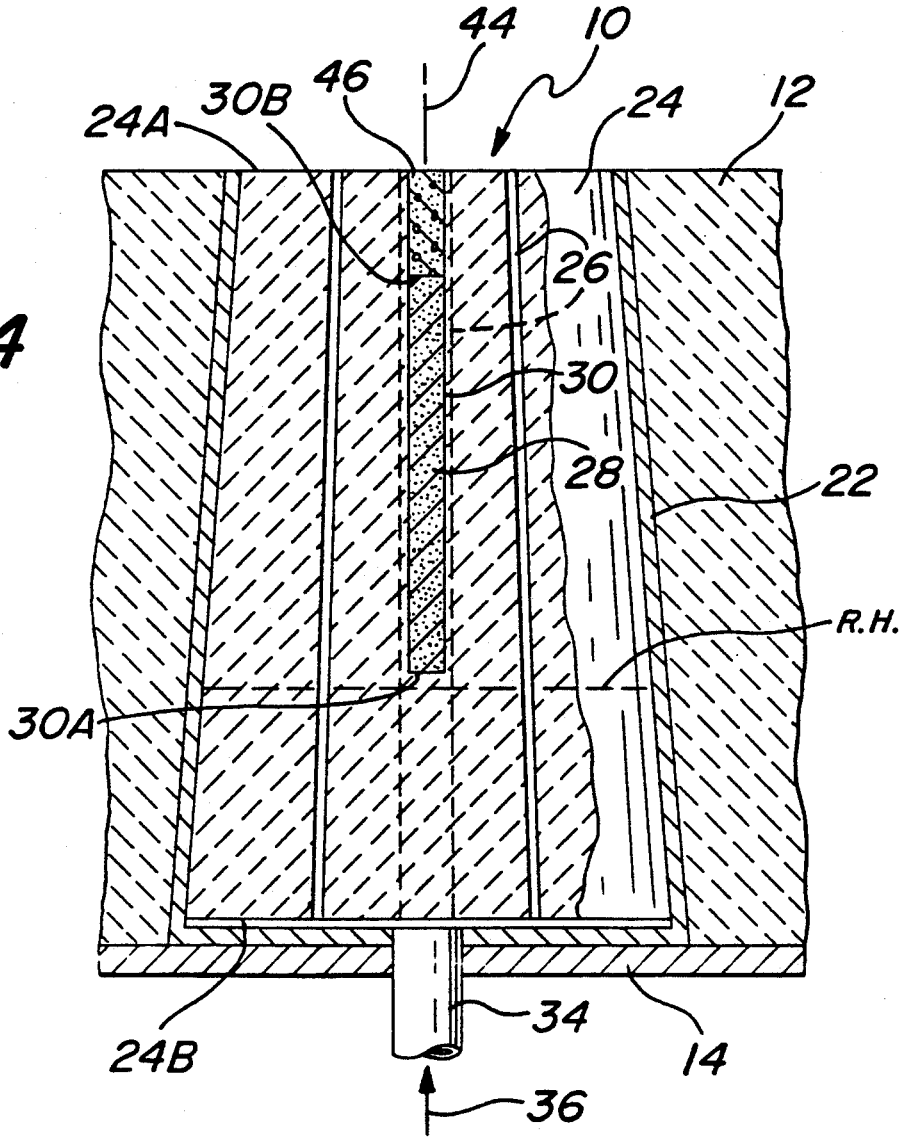
FIG. 4 is a front elevational view, partially in section, showing the stirring plug of this invention in a second manner of use in a refractory block lined steel making vessel.

Referring now to various figures of the drawing where like reference numerals refer to like parts, there is shown in FIG. 1, one embodiment of a stir plug 10 constructed in accordance with this invention. As is conventional the stir plug 10 is arranged to be located within a ceramic or other refractory material seating block or brick 12 forming one portion of a refractory lining of steel making vessel, e.g., ladle, 14. To that end as can be seen in FIG. 1 the plug 10 is shown disposed so that a portion of the brick 12 is interposed between the bottom of the plug 10 and the vessel 14. In FIG. 4 the plug 10 is shown in an alternative disposition within the brick, i.e., disposed directly on the wall of the vessel 14 without any portion of the brick 12 disposed therebetween.

The plug 10 is constructed generally in accordance with the teachings of U.S. Pat. No. 5,104,097, entitled Gas Stir Plug With Slots Method Of Making The Same, whose disclosure is incorporated by reference herein, and thus basically comprises a frusto-conically shaped shell 22 having a dense core 24 located therein. A plurality of passageways or slots 26 extend through the plug 24 for transporting a stirring gas through the plug from its bottom end or surface 24B to its top end or surface 24A, as will be described later. Unlike the stir plug of the aforementioned patent, the stir plug 20 of this invention includes a visual wear indicator 28. That indicator basically comprises a central body of a low melting point component or material located within a like shaped internal cavity 30 in the core 24. The details of the wear indicator 28 and the cavity in which it is disposed will be described later.

The shell 22 is preferably formed of any suitable material, such as stainless steel, a fired ceramic or a ceramic coated metal. The shell includes a generally planar bottom wall 32 having an inlet port or conduit 34, into which any suitable stirring gas may be introduced in the direction of the arrow 36, and a peripherally extending conical side wall 38 terminating at its upper end in an opening 40.

The core 24 is formed of any suitable refractory material, e.g., it is a dense, non-permeable ceramic material, and is shaped to closely fit within the interior of the shell 22. The sidewall 38 of the shell may extend the entire height of the plug, as shown herein, or may extend only partially, e.g., from one third to one half, of the height of the plug. The core 24 is of frusto-conical shape and includes a conical outer surface 42 extending between the top surface 24A and the bottom surface 24B and about the central longitudinal axis 44 of the plug 20. The bottom and top surfaces of the plug are each substantially planar, and are disposed perpendicularly to the central longitudinal axis 44 of the plug.

Figure 2:
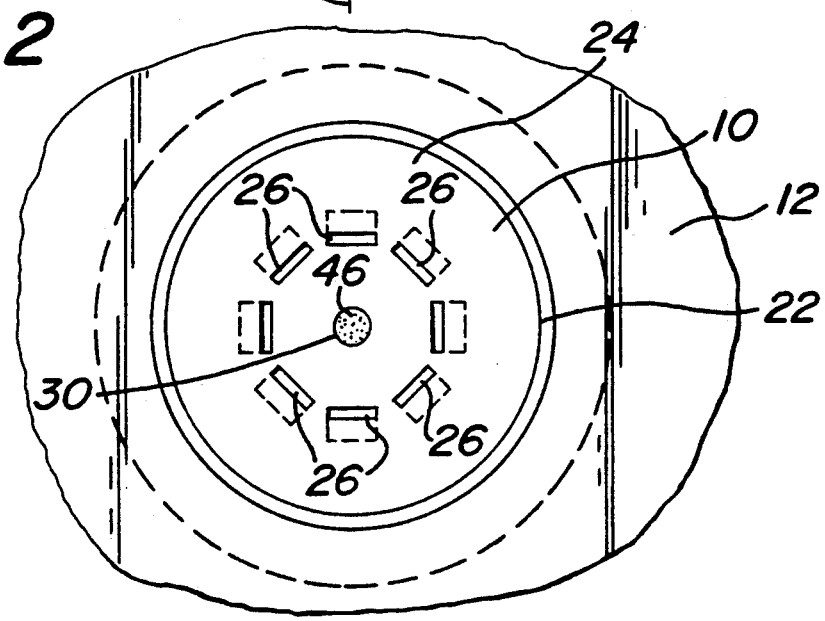
FIG. 2 is a top plan view of the stirring plug within the refractory vessel shown in FIG. 1.

As can be seen in FIGS. 1, 2 and 4, there are preferably eight slots 26 in the core 24. The slots 26 are disposed in a frustum-shaped array about the central longitudinal axis 44 of the plug between its top surface 24A and its bottom surface 24B. The slots serve to carry the stirring gas introduced into the plug via conduit 34, out through the top end of the plug, to stir molten metal, e.g., steel, in the brick-lined vessel 14. If desired the core may include more or less than the eight slots 26 shown herein.

Preferably the walls forming the periphery of the slots are smooth so that each slot can transport gas therethrough with low frictional loss from the bottom of the plug to its top. Moreover, the slots are configured to minimize the danger of slot blockage caused by the intrusion and freezing of the metal in the slot as the plug wears down should the flow of gas therethrough become interrupted or terminated.

It must be pointed out that the number, size and orientation of the slots 26 shown is merely exemplary. Moreover, the spacing of the slots radially, i.e., the distance of the slots from the outer surface 42 of the plug, can be any desired value depending upon the size of the plug itself. However, it is preferred that the distance between each slot and the outer surface of the plug immediately adjacent thereto at the top of the plug be smaller than that distance at the bottom of the plug.

As will be appreciated by those skilled in the art, utilizing slots arranged in a frustum array causes the plugs to be resistant to any cracking which may propagate to the surface of the plug. Moreover, the spacing of the slots vis-a-vis one another, decreases from the bottom of the plug to its top, whereupon the nominal fracture location tends to occur at the top of the plug rather than at its bottom.

Figure 3:
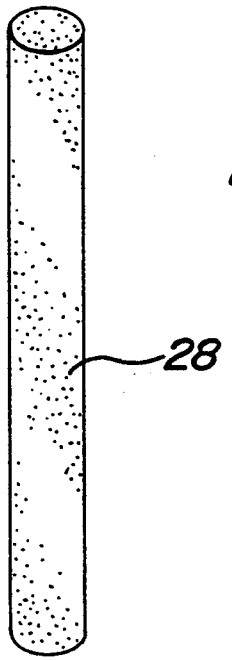
FIG. 3 is an enlarged, isometric view of the low melting point component of the stirring plug shown in FIG. 1.

Referring now to FIGS. 1, 3, and 4 the details of the visual wear indicator 28 of the present invention will be considered. As can be seen that wear indicator basically comprises a generally cylindrical mass or body of a low melting point material, e.g., soapstone, calcium silicate, talcum, or some other material having a melting point below that of steel. The low melting point component resides, i.e., is held, within the lower portion of the cavity 30 in the core 28. The cavity 30 is centered on the longitudinal central axis 44 of the plug 10 and extends down from the top surface 24A to a point located a predetermined height above the bottom surface 24B of the plug. In particular, the bottom 30A of the cavity 30 is disposed just above the residual or remnant height of the plug, i.e., the height that the plug 10 will be allowed to wear away to before it should be replaced. This height is designated by the dotted line bearing the legend R.H.

The low melting point component 28 extends from the bottom 30A of the cavity to an intermediate point 30B below to top surface of the plug. The remainder of the cavity, i.e., the portion of the cavity above the low melting point component, is filled with a high melting point refractory material component 46, e.g., high grade mortar or a high grade plastic ram mix. The high grade mortar or the high grade plastic ram mix at the top of the cavity is likely to provide improved resistance to erosion by the molten steel over that provided by the prior art. In particular the improved erosion resistance effected by the high grade refractory component 46 should provide a substantially improved service life of the stir plug as compared to the wear indicator plug of the Labate patent 4,744,544. In this regard erosion through the hole drilled in the plug to receive the metal rod wear indicator of the Labate device is likely to occur immediately after the liquid steel is introduced into the vessel, e.g., ladle, in which the plug is located. In contradistinction, the high grade component 46 of the device of this invention prevents the plug from being prematurely eroded during the entire period of time that it takes the plug to normally wear down to point 30B, i.e., the top of the low melting point indicator component 28.

As should be appreciated by those skilled in the art when the plug 10 is first exposed to molten steel the steel will contact the top surface of the plug to cause it to begin to wear away or erode. Until the plug has worn away to the point 30B where the bottom of the high grade mortar 46 meets the top of the low melting point component, the plug when viewed from the top will be of a generally uniform appearance since the refractory material making up the core 24 and the mortar will be similar in color and surface texture. However, once the plug has eroded to the point 30B at which the top of the low melting point component is reached, the low melting point component will be exposed to the molten steel in the vessel 14. This action will cause the low melting point component to melt or vaporize and flow out of the cavity 30 in which it had been residing, whereupon molten steel will flow therein. Thus, the appearance of the top of the plug will change. In this regard, after a heat of steel is emptied from the vessel a person looking into the vessel over the top of the plug will see a glowing core or dot of molten or solidified metal surrounded by a darker colored area, i.e., the refractory material core 24. The glowing core or dot, hereinafter referred to as a "magic eye", provides a markedly different and readily discernable appearance from the surrounding refractory material, thereby alerting the observer that the plug is nearing its residual or remnant height point at which it (and possibly the vessel lining bricks 12) should be replaced. In particular, the plug should be monitored once the magic eye appears to ensure that after each heat of steel is emptied from the vessel that the magic eye still appears. If so the plug 10 will have a residual height in excess of the remnant height at which it should be replaced. Once the plug has eroded to the point 30A equal to the bottom of the cavity 30 the magic eye will disappear, i.e., no further glowing metal will reside within the core. Thus, all that will be visible at this time is the body or core 24 of the plug 10. When this is observed the plug should be replaced.

In accordance with a preferred embodiment of the invention the height of the low melting point component within the cavity makes up substantial, e.g., a major, portion of the cavity, so that several heats of steel can be made while the magic eye still appears. This should provide ample opportunity for the magic eye to be observed by operating personnel during one of those heats, thereby alerting the operating personnel that they should be on guard to observe the disappearance of the magic eye, since that action will signify the need to replace the plug. For example, for a stirring plug having a height of 15 inches (38.1 cm), it may be desirable to replace the plug when it has worn away to a residual height of 5 inches (12.7 cm). Accordingly, for such a plug the height of the cavity 30 will be approximately 8 inches (20.3 cm) so that its bottom 30A will be located approximately 5 inches (12.7 cm) above the bottom of the plug. The 8 inch length of low melting point component 28 should provide a magic eye through several heats of steel making.

It should be pointed out at this juncture that the subject invention can be used in any type of stirring plug, not only in the canistered slotted plugs shown and described heretofore. Moreover, the use of a high melting point refractory material to fill the top of the cavity above the low melting point component is not mandatory. Thus, for example the low melting point component may extend the entire height of the cavity to the top of the plug. Further still, the length of the low melting point component may be substantially less than that described heretofore so that it is confined to an area immediately adjacent the remnant height point. In such an arrangement it may be desirable to utilize a high melting point refractory component to fill the major length of the cavity above the low melting point material. Such an arrangement, while providing less warning time to operating personnel, never the less offers increased wear resistance.

Without further elaboration the foregoing will so fully illustrate our invention that others may, by applying current or future knowledge, adapt the same for use under various conditions of service.

We claim:

1. A device for introducing gas into a mass of molten metal comprising a plug which is worn away during use and which should be replaced when said plug has worn away to a remnant height point, said plug comprising a central longitudinal axis, a top end, a bottom end, a core, and a low melting point component, said core being comprised of a refractory material extending between said bottom end and said top end, said core having a cavity therein, said cavity having a bottom located adjacent said remnant height point and extending upward therefrom along said longitudinal axis, said low melting point component being located within said cavity and extending from the bottom of said cavity to an intermediate point thereabove, said plug being arranged so that when said plug has been worn away to said intermediate point by said molten metal said low melting point component melts and flows out of said cavity and said molten metal flows into said cavity to provide a first visual appearance, said first visual appearance changing to a second visual appearance when said plug has worn away to said remnant height point.

2. The device of claim 1 additionally comprising a passageway extending between said bottom end and said top end of said core through which said gas is passed from said bottom end to said top end to exit therefrom.

3. The device of claim 1 additionally comprising a high melting point component disposed within said cavity above said low melting point component from the top of said low melting point component to said top end of said plug.

4. The device of claim 3 wherein said high melting point component comprises high grade mortar.

5. The device of claim 1 wherein said low melting point component comprises a material selected from the group of soapstone, talcum, and calcium silicate.

6. The device of claim 2 additionally comprising a high melting point component disposed within said cavity above said low melting point component from the top of said low melting point component to said top end of said plug.

7. The device of claim 6 wherein said high melting point component comprises high grade mortar.

8. The device of claim 6 wherein said low melting point component comprises a material selected from the group of soapstone, talcum, and calcium silicate.

9. The device of claim 7 wherein said low melting point component comprises a material selected from the group of soapstone, talcum, and calcium silicate.

10. The device of claim 1 wherein said plug is disposed within a shell.

11. The device of claim 10 wherein said plug is frustoconical in shape.

12. The device of claim 2 wherein said plug is disposed within a shell.

13. The device of claim 12 wherein said plug is frustoconical in shape.

14. A method of determining when a stirring plug introducing gas into a mass of molten metal has worn away to a predetermined height by said molten metal, said plug comprising a central longitudinal axis, a top end, a bottom end, a core having a cavity therein, and a low melting point component, said method comprising disposing said low melting point component within said cavity so that the top of said low melting point component is located at an intermediate point between said top end and said bottom end of said plug, exposing said plug to molten metal at the top of said plug so that said plug is worn away by said molten metal, whereupon when said plug has worn away to said intermediate point said low melting point component melts and flows out of said cavity and said molten metal flows into said cavity to provide a first predetermined visual appearance.

15. The method of claim 14 additionally comprising leaving said plug in place so that it wears away to said predetermined point, whereupon said first predetermined visual appearance changes to a second predetermined visual appearance, thereby indicating that said plug should be replaced.

* * * * *